US005474183A

United States Patent [19]

Warren et al.

[11] Patent Number: 5,474,183

[45] Date of Patent: Dec. 12, 1995

[54] CARTON FOR ENCLOSING AND DISPLAYING ARTICLES

[75] Inventors: Stephen J. Warren, Hamlin; John M. Azzarone, Rochester; William I. Blazey, Walworth, all of N.Y.

[73] Assignee: Eastman Kodak Company, Rochester, N.Y.

[21] Appl. No.: 268,900

[22] Filed: Jun. 30, 1994

[51] Int. Cl.[6] ..... B65D 5/10; B65D 5/54

[52] U.S. Cl. ..... 206/459.5; 206/806; 206/831

[58] Field of Search ..... 206/459.5, 45.12, 206/45.25, 806, 831

[56] References Cited

U.S. PATENT DOCUMENTS

| | | | |
|---|---|---|---|
| 3,395,792 | 8/1968 | Larson | 206/831 X |
| 4,103,820 | 8/1978 | Mathison et al. | 206/831 X |
| 4,108,350 | 8/1978 | Forbes, Jr. | 229/37 R |
| 4,308,679 | 1/1982 | Ray, III et al. | 206/831 X |
| 4,308,986 | 1/1982 | Parrilli | 206/806 X |
| 4,315,569 | 2/1982 | Jaeschke | 206/806 X |
| 4,355,758 | 10/1982 | Lavery | 206/806 X |
| 4,549,654 | 10/1985 | Tiesman | 206/806 X |
| 5,341,923 | 8/1994 | Arasim | 206/831 X |

*Primary Examiner*—Jacob K. Ackun

*Attorney, Agent, or Firm*—Clyde E. Bailey, Sr.; Charles E. Snee, III

[57] ABSTRACT

A carton (10) for enclosing and displaying articles has a detachably attached portion (34) integral to a support member (26) for displaying the carton (10) from a rack hanger. The detachable portion (34) can be removed without exposing the support member (26) or carton (10) to damage.

13 Claims, 5 Drawing Sheets

CARTON FOR ENCLOSING AND DISPLAYING ARTICLES

FIELD OF THE INVENTION

The invention relates to a carton and method for enclosing and displaying articles. More particularly, the invention concerns a carton including a structurally integral member having a detachable portion thereon, such as a support member having a removable, instantly redeemable coupon portion, which can be removed without affecting the integrity of the carton.

BACKGROUND OF THE INVENTION

Conventional marketing practices for over the counter-type products packaged in cartons or the like, involve the use of a redeemable coupon. Such coupons may, for instance, offer a rebate or free or discounted product on current or future purchases.

One way to provide a removable instant redeemable coupon is to incorporate the coupon in a label that is affixed, via an adhesive, to the carton.

A shortcoming of labeling the carton is the need for an additional operation to apply the label. The structural integrity of the carton may also be affected when the label is removed. In general, a labeling operation will run at a slower rate than a normal carton filling operation, causing the need to slow down filling speeds or requiring the use of multiple labelers. Using a label also creates another component of the package. All of these disadvantages require additional cost in the manufacture of the carton. Another disadvantage of applying a label is the amount of adhesive and backer material that will be left on the carton after the label has been removed. This condition could cause complications in the recycling of the carton material. Finally, if the carton is not specifically designed for the use of a label, the graphics and or text would be covered on the carton.

Other attempts in the prior art to provide a redeemable coupon are illustrated in FIGS. 1 and 2 which show a carton 1 of a type disclosed in U.S. Pat. No. 4,108,350. An extra flap 2 of material comprising the coupon is added to the carton 1 having side walls 3 and end walls 4. This extra flap 2 does not contribute to the structural integrity of the carton 1. The flap 2 is merely surplusage detachably attached to an exterior glue flap 5 that seals the assembled carton 1. In this arrangement, the extra flap 2 serves no other purpose but as a detachable coupon. Further, the fabrication of a carton having such an extra flap would require a slower gluing speed and possible additional handling to prevent premature removal of the coupon flap. Filling speeds would also be reduced to prevent damage to the coupon flap of the carton assembly.

Other existing cartons that contain instantly removable coupons typically expose the contents of the carton to damage and/or pilfering. Further, premature removal of the removable coupon makes the carton less attractive, thus less salable to the consumer. Moreover, the structural integrity of the carton may well be compromised if the redeemable coupon is removed and the product exposed.

Despite the various improvements represented by the above examples; an almost universal objective to be accomplished is to provide a removable, instantly redeemable coupon which, when removed does not compromise the integrity of the package.

Therefore, a need persists for an easy to produce, cost effective carton having an easily instantly redeemable coupon portion that, when removed, does not effect the structural integrity of the carton nor expose the product contained therein to damage.

SUMMARY OF THE INVENTION

To overcome one or more problems in the prior art, there is provided, in one aspect of the invention, a carton for enclosing and displaying articles therein, the carton comprising:

a single paperboard blank including at least three side walls and a pair of support panels; a first of the support panels being foldably joined to one of the side walls; a second of the support panels being joined to another of the side walls; and a first transverse perforation line through one of the support panels, the first perforation line being spaced from the joined side wall to define a coupon portion of the one support panel and to permit removal of the coupon portion by tearing the one support panel along the perforation line. The support panels may be foldably joined by a second transverse perforation line spaced from the first perforation line, the coupon portion thus being removable by tearing along both perforation lines. A plurality of end flaps may be foldably attached to end edges of the side walls. Congruent openings may be provided through the support panels, for supporting the carton. Adjacent side walls may be foldably joined along score lines. The side walls may form an essentially rectanguloid box. The perforation lines may include full cut starting portions to ease removal of the coupon portion. The second support panel may be joined to the other side wall without folding, whereby the second support panel is erect when the carton is assembled.

Accordingly, an important advantage of the present invention is that it provides an easy to manufacture, and inexpensive carton having an integral structural member with an easily removably, instantly redeemable coupon portion that can be removed without destroying the integrity of the carton or exposing the product to damage.

BRIEF DESCRIPTION OF THE DRAWINGS

The foregoing as well as other objects, features and advantages of this invention will become more apparent from the appended Figures, wherein like reference numerals denote like elements, and wherein.

DETAILED DESCRIPTION OF THE INVENTION

Figure 1:
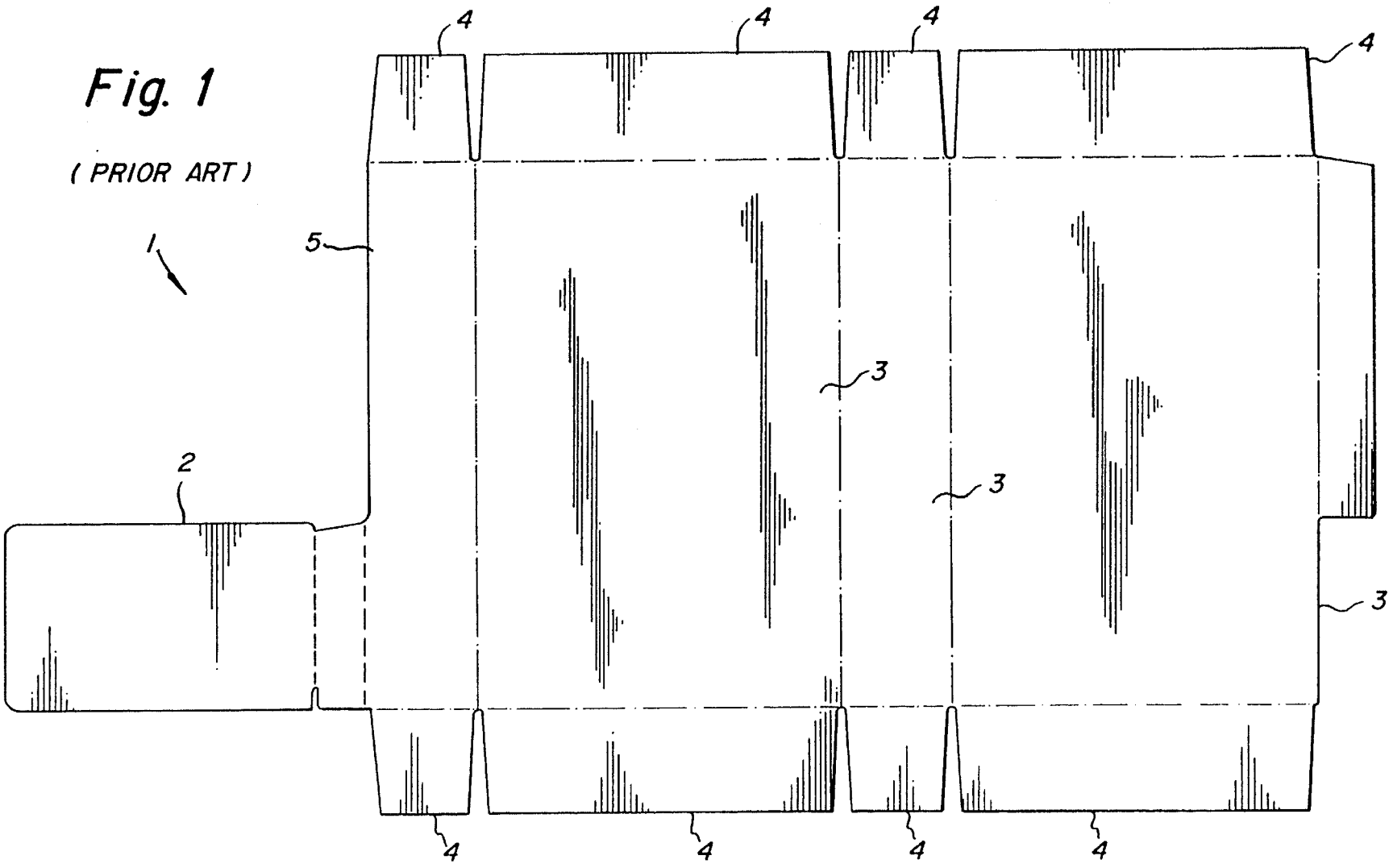
Fig. 1 ( PRIOR ART )
FIG. 1 shows a plan view of a prior art carton blank having a detachable panel or coupon.
Figure 2:
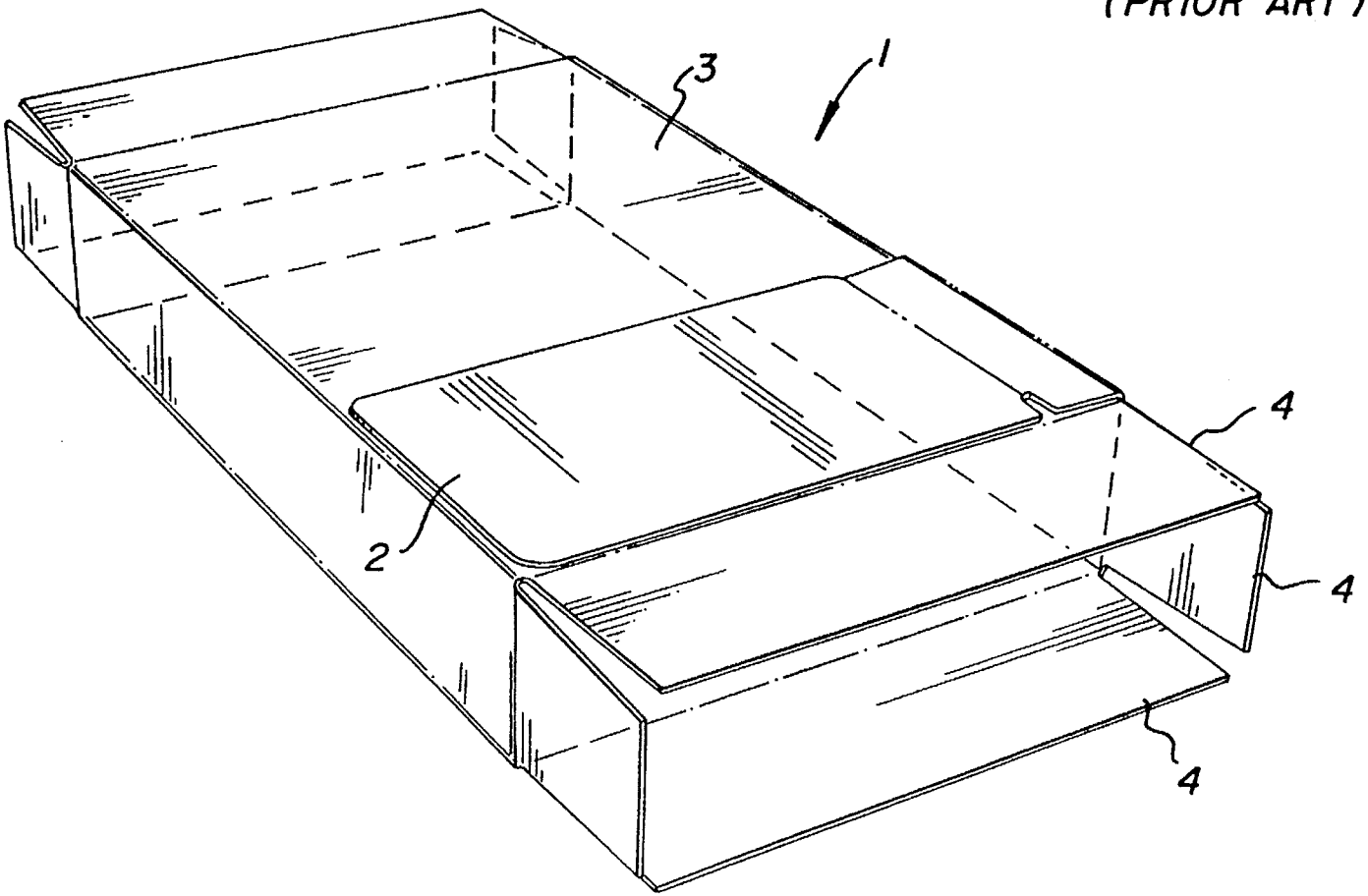
Fig. 2 (PRIOR ART)
FIG. 2 shows a perpective view of the assembled container of FIG. 1.
Figure 3:
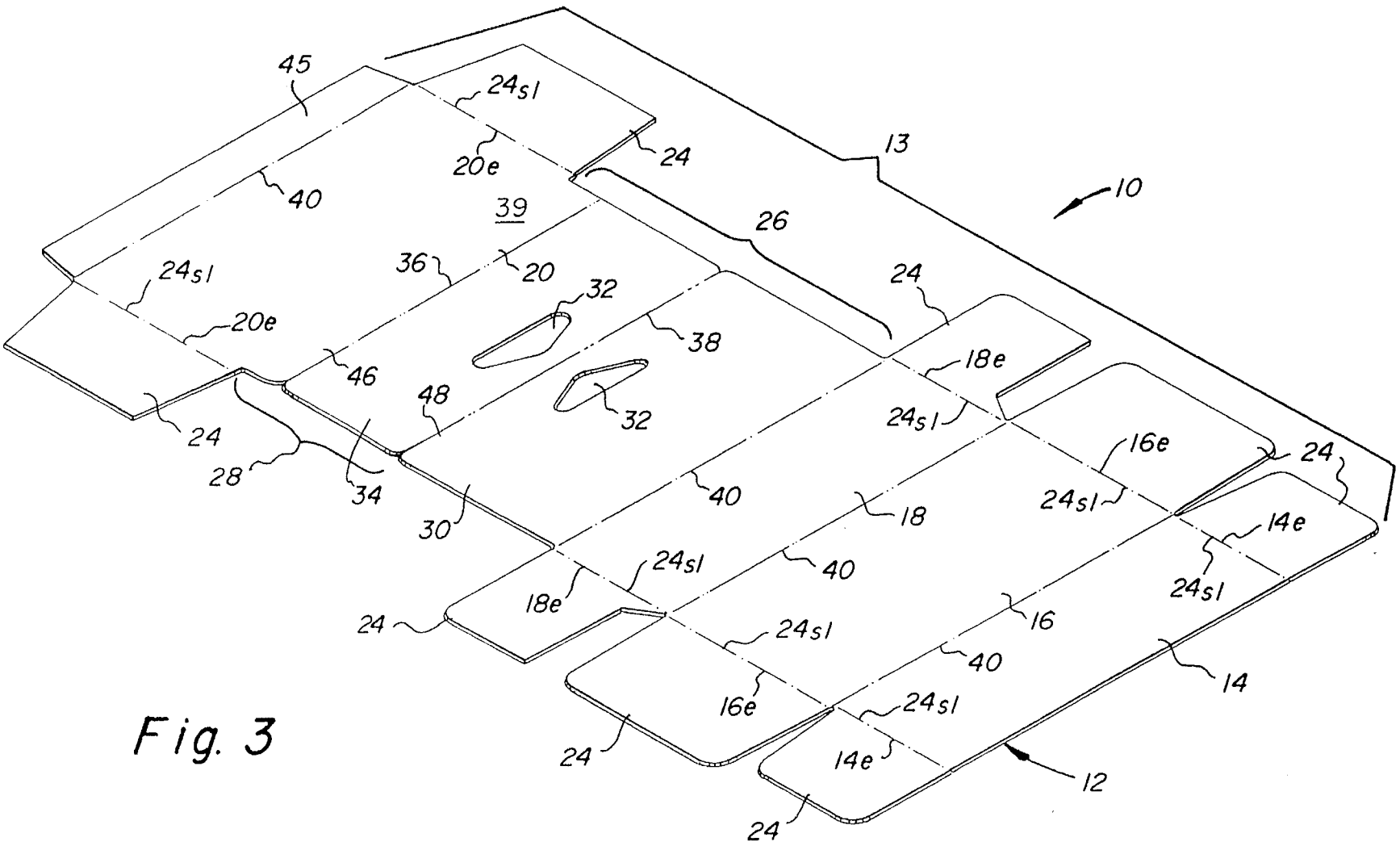
FIG. 3 shows a perspective view of a carton blank according to the present invention.
Figure 4:
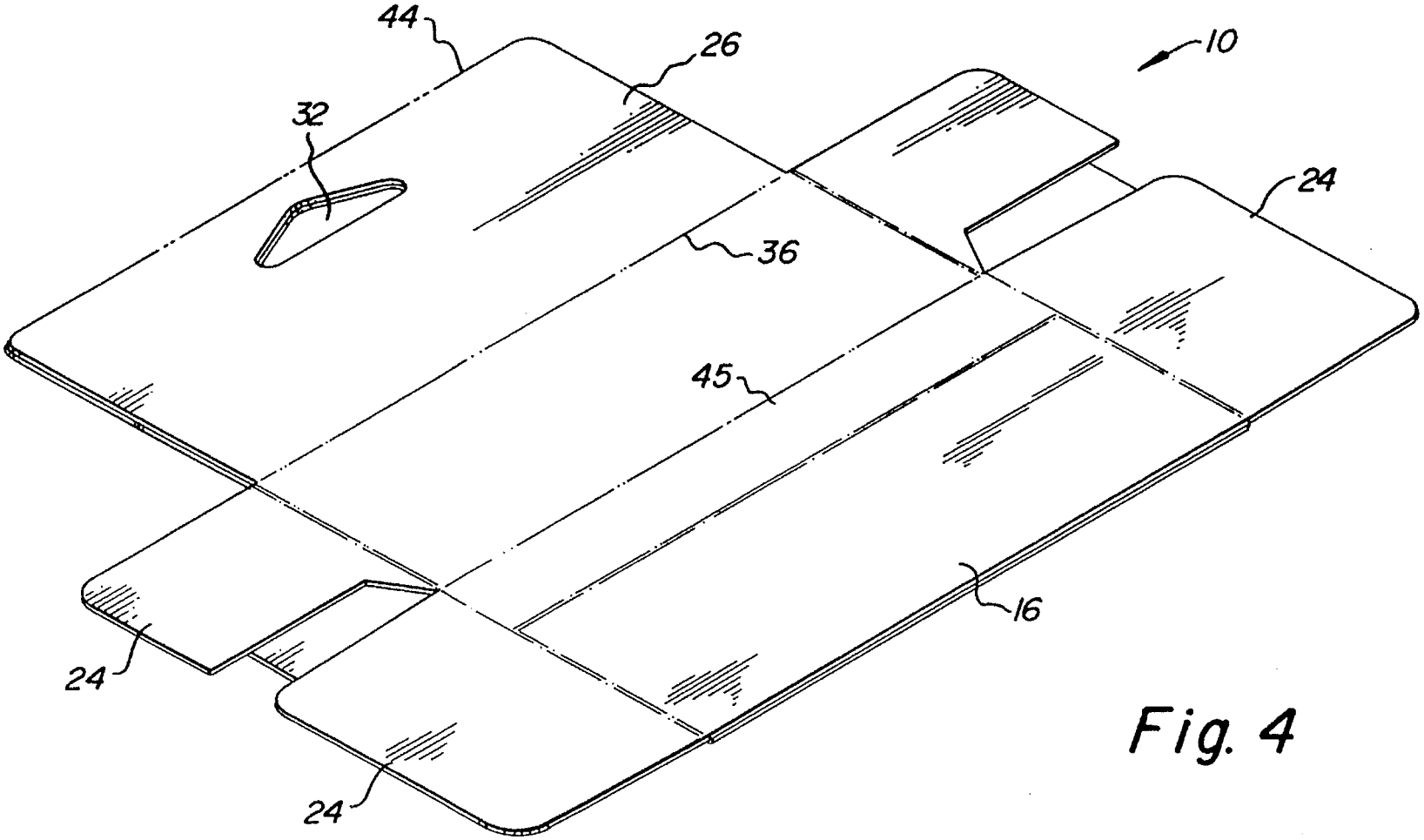
FIG. 4 shows a perspective view of a partially assembled carton made using the blank of FIG. 3; and, FIG. 5 is a rear perspective view of the fully assembled carton of FIG. 3 with the coupon portion shown partially removed.
Figure 5:
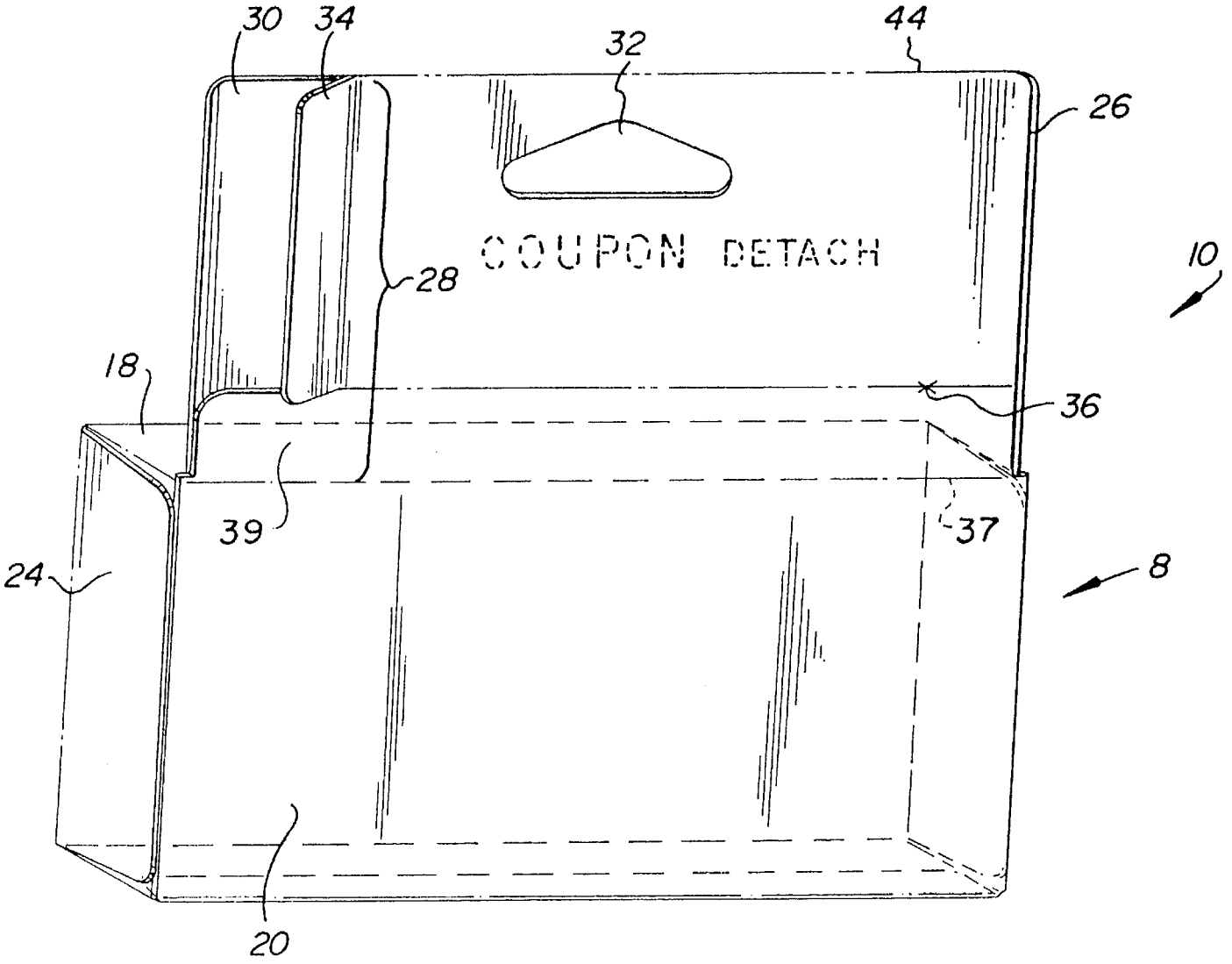

Turning now to the drawings, and more particularly to FIG. 3–5, there is shown carton 10 constructed in accordance with the principles of the invention.

Broadly defined, carton 10 generally comprises a single paperboard blank 12 cut to have a main body portion 13, side walls 14,16,18,20 foldably attached to the main body portion 13, and foldable end flaps 24 attached to either end edge 14*e*, 16*e*,18*e*,20*e* of a respective side wall 14,16,18,20. According to the invention, blank 12 may be made of virgin or recycled paperboard, such as, clay coated newsback having a thickness of 0.012 inches to about 0.030 inches. Furthermore, carton 10 includes a support member 26 comprising first and second support panels or sides 28, 30 attached to and positioned between adjacent side walls 18, 20. First and second sides 28,30 provide structural integrity, i.e., rigidity and strength, to the support member 26 necessary for sustaining the carton 10 while supporting the weight of the carton 10 and the article enclosed therein or to support carton 10 that is frequently removed and re-mounted on the display hanger (not shown). The support member 26, preferably has congruent through openings 32 (when assembled) passing through the first and second sides 28,30 for providing a means of displaying the carton 10 from a rack hanger (not shown), or the like, having means to supportably engage the through openings 28,30.

As shown in FIGS. 3–5, first or second side 28,30 has a detachably attached coupon portion 34 thereon. In the preferred embodiment, portion 34 may be a removable instantly redeemable coupon, attached along parallel transverse perforation lines 36,38 in the first side or second side 28,30, preferably the first side 28, which may be designated the back side of the carton 10. The perforation lines extend completely across the width of the support panel, as seen clearly in FIG. 3. As shown in FIG. 5, perforation line 36 is spaced from a corner 37 of the assembled carton by a lower, transverse portion 39 of support panel 28, portion 39 being integrally joined, without folding, to side wall 20.0.

The carton blank 12, described above, can be glued together by the straight line application of adhesive or with pad application of adhesive. According to FIGS. 3–4, a glue flap 45 attached to side wall 20 is provided for adhesively assembling the carton 12. One method of gluing the carton 12 is to first fold the side walls 12,16,18,20 over along score lines 40 until the rectanguloid shaped box (B) is formed. Then, the end flaps 24 are folded along their respective score lines $24_{sl}$ along side wall edges 14*e*,16*e*,18*e*,20*e* toward an opposite side wall edge 14*e*,16*e*,18*e*,20*e*, and a line of glue is applied to the end flaps 24 thereby closing a respective end of of the assembled carton 10. The support member 26 is folded upwardly from its position in the blank 13 along scores 40 adjacent side wall 18 and along perforation 38, so that the through openings 32 passing through first and second sides 28,30 are congruent.

FIGS. 4 and 5, illustrate carton 10, for enclosing and displaying articles (not shown), in partially assembled and fully assembled states. When assembled, side walls 14,16, 18,20 and end flaps 24 are configured to form a box B, having preferably a generally rectanguloid-shaped, although any shape, such as a trianguloid, may also come within the definition of the invention. Thus, at least three side walls are needed for a box-like package. As shown clearly in FIGS. 3 and 5, detachably attached coupon portion 34 on first side 28 of support member 26 is provided with graspable portions for enabling fingers to lift and tear away portion 34 along perforations 36,38 with relative ease, as described in details below.

According to FIG. 3, side walls 14,16,18,20 are adjoined along peripheral edges 14*e*,16*e*,18*e*,20*e* of an adjacent side wall 14,16,18,20 by substantially parallel score lines 40. Score lines 40 assures that the carton 10 will have foldability characteristics.

Support member 26 allows the back of the carton 10 to extend vertically relative to the box B as a means of hanging the carton 10 for display purposes. The two substantially parallel perforations 36,38 allow easy removal of portion 34, which, when removed, does not compromise the function of the carton 10. Additionally, portion 34 provides added space for graphics on the front and back sides (not shown). Graphics can be planned for the bottom (not shown) of the carton 10 that remains, so that if any offer expires the coupon or portion 34 can be removed. The removable portion 34 of the carton 10 can also be printed on both sides with just about any printing operation, such as offset and flexography.

As indicated above, the detachably attached or removable portion 34 is attached between the first side 28 and the second side 30 of the support member 26 by perforation lines 36,38. Although various numbers of perforation patterns are available that allow removal of portion 34 (or instant redeemable coupon), the arrangement of perforations 36,38, shown in FIG. 3, is deemed to permit the easiest removal of portion 34. Additionally, the arrangement of perforations 36,38 is designed to allow portion 34 (coupon) to be removed cleanly. This design allows coupon perforation rule(s) in the die to be removed when an coupon is not requested. Moreover, with the removable portion 34, which is integral to the support member 26 (as described above), one die can be utilized in the fabrication process for greater flexibility in manufacturing. When the retailer receives the assembled carton 10, with or without a removable portion 34, the structure of the carton 10 is the same. The perforation line 38 becomes the top end 44 of the support member 26, when fully assembled. The removable portion 34 (or coupon) is defined by the surface between perforations 36 and 38, respectively. Skilled artisans will appreciate that the size of the surface between score lines is a matter of design choice. According to FIG. 3, portion 34 (coupon) is easily removed from the first side 28 of support member 26 by first grasping the starting full cut portions 46,48, and then pulling portion away from the first side 28 along perforations 36,38.

In another aspect of the invention, a method of providing a detachable portion 34 on a display carton 10 without exposing the carton 10 to damage when the portion 34 is detached comprises the step of providing a carton 10 comprising a box (B) having opposing and adjacent side walls 14,16,18,20 and opposing end flaps 24 foldably attached to the end edges 14*e*,16*e*,18*e*,20*e* of side walls 14,16,18,20. As indicated above, the side walls 14,16,18,20 and end flaps 24 are configured to form the closable and openable box (B).

Moreover, a support member 26 is provided having first and second opposite sides 28, 30, the first side 28, preferably, having at least a portion 34 (described in details above) of which is detachably attached to the second side 30, as fully described above. As depicted in FIGS. 3–5, support member 26 further has means for supportably displaying the carton 10, preferably congruent through openings 32 passing through said first and second opposite sides 28,30.

Further, in this aspect of the invention, a portion of the first side 28 of the support member 26 is structurally attached to one of the adjacent side walls 14,16,18,20 (FIG. 3); and, a portion of the second side 30 of the support member 26 is foldably attached to an opposing side wall so that the through openings 32 for displaying the carton 10 congruent and exposed.

The invention has therefore been described with reference to certain embodiments thereof, but it will be understood that variations and modifications can be effected within the scope of the invention.

We claim:

1. A carton for enclosing and displaying an article, comprising: a single paperboard blank including at least three side walls (14, 16, 18, 20) and a pair of support panels (28, 30); a first of the support panels (30) being foldably joined (40) to one of the side walls ( 18); a second of the support panels (28) being joined to another of the side walls (20); and a first transverse perforation line (36) extended completely across a width of one of the support panels, the first perforation line being spaced from the joined side wall to define a coupon portion (34) of the one support panel and to permit removal of the coupon portion by tearing the one support panel completely transversely along the perforation line.

2. A carton according to claim 1, wherein the support panels are foldably joined by a second transverse perforation line (38) spaced from the first perforation line, the coupon portion thus being removable by tearing along both perforation lines.

3. A carton according to claim 1, further comprising a plurality of end flaps (24) foldably attached ($\mathbf{24}_{sl}$) to end edges of the side walls.

4. A carton according to claim 1, further comprising congruent openings (32) through the support panels, for supporting the carton.

5. A carton according to claim 1, wherein adjacent side walls are foldably joined along score lines (40).

6. A carton according to claim 1, wherein the side walls form an essentially rectanguloid box.

7. A carton according to claim 1, wherein the perforation line comprises a full cut starting portion (46) to ease removal of the coupon portion.

8. A carton according to claim 2, wherein the perforation lines comprise full cut starting portions (46, 48) to ease removal of the coupon portion.

9. A carton according to claim 1, wherein the second support panel is joined to the other side wall without folding, whereby the second support panel is erect when the carton is assembled.

10. A carton for enclosing and displaying an article, comprising: a single paperboard blank including at least three side walls (14, 16, 18, 20) and a pair of support panels (28, 30); a first of the support panels (30) being foldably joined (40) to one of the side walls ( 18); a second of the support panels (28) being joined to another of the side walls (20) without folding, whereby the second support panel is erect when the carton is assembled; congruent openings (32) through the support panels, for supporting the carton; a first transverse perforation line (36) extended completely across a width of one of the support panels, the first perforation line being spaced from the joined side wall to define a coupon portion (34) of the one support panel and to permit removal of the coupon portion by tearing the one support panel completely transversely along the perforation line; the support panels being foldably joined by a second transverse perforation line (38) spaced from the first perforation line, the coupon portion thus being removable by tearing completely transversely along both perforation lines; and the perforation lines comprising full cut starting portions (46, 48) to ease removal of the coupon portion.

11. A carton according to claim 10, further comprising a plurality of end flaps (24) foldably attached ($\mathbf{24}_{sl}$) to end edges of the side walls.

12. A carton according to claim 10, wherein adjacent side walls are foldably joined along score lines (40).

13. A carton according to claim 10, wherein the side walls form an essentially rectanguloid box.

* * * * *